US011152718B2

(12) United States Patent
Miyamura et al.

(10) Patent No.: US 11,152,718 B2
(45) Date of Patent: Oct. 19, 2021

(54) ELECTRICAL CABLE INCLUDING TERMINAL HAVING PRESSING PORTION THAT PRESSES HOLDING PORTION

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP); TOYOTA JIDOSHA KABUSHIKI KAISHA, Aichi-ken (JP)

(72) Inventors: Tetsuya Miyamura, Mie (JP); Hideki Matsunaga, Mie (JP); Takamaru Amano, Mie (JP); Masaaki Tabata, Mie (JP); Yasuo Omori, Mie (JP); Teruo Hara, Mie (JP); Shunya Takeuchi, Mie (JP); Takeshi Misaiji, Aichi-ken (JP); Hiroshi Kobayashi, Aichi-ken (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP); TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/967,588

(22) PCT Filed: Feb. 1, 2019

(86) PCT No.: PCT/JP2019/003564
§ 371 (c)(1),
(2) Date: Aug. 5, 2020

(87) PCT Pub. No.: WO2019/159714
PCT Pub. Date: Aug. 22, 2019

(65) Prior Publication Data

US 2021/0273351 A1 Sep. 2, 2021

(30) Foreign Application Priority Data

Feb. 15, 2018 (JP) ..... JP2018-025371

(51) Int. Cl.
*H01R 4/28* (2006.01)
*H01B 7/00* (2006.01)
*H01R 13/11* (2006.01)

(52) U.S. Cl.
CPC ..... *H01R 4/28* (2013.01); *H01B 7/0009* (2013.01); *H01R 13/11* (2013.01)

(58) Field of Classification Search
CPC ..... H01R 4/28; H01B 7/0009; H01B 7/0045
(Continued)

(56) References Cited

U.S. PATENT DOCUMENTS 4,973,262 A 11/1990 Gerke et al.
7,306,495 B2 12/2007 Hashimoto et al.
(Continued)

FOREIGN PATENT DOCUMENTS

CN 1041486 4/1990
CN 1871747 11/2006
(Continued)

OTHER PUBLICATIONS

International Search Report issued in International Patent Application No. PCT/JP2019/003564, dated Mar. 19, 2019, together with English translation thereof.
(Continued)

*Primary Examiner* — Harshad G Patel
(74) *Attorney, Agent, or Firm* — Greenblum & Bernstein, P.L.C.

(57) ABSTRACT

An electric cable including a terminal includes an electric wire and a female terminal. The female terminal includes a
(Continued)

first holding portion and a second holding portion that hold the electric wire. The female terminal includes a first pressing portion and the second pressing portion pressing the first holding portion and the second holding portion toward the electric wire. The first holding portion and the second holding portion include a first protrusion and a second protrusion, respectively. The first protrusion and the second protrusion protrude toward the electric wire. A core wire of the electric wire includes a recess in which the first protrusion and the second protrusion are fitted.

6 Claims, 18 Drawing Sheets

(58) Field of Classification Search
USPC ..... 439/775
See application file for complete search history.

(56) References Cited

U.S. PATENT DOCUMENTS

| | | | | |
|---|---|---|---|---|
| 7,377,803 | B2 | 5/2008 | Matsuoka | |
| 8,662,935 | B2 | 3/2014 | Jouas et al. | |
| 2005/0026515 | A1 | 2/2005 | Hashimoto et al. | |
| 2007/0134946 | A1 | 6/2007 | Matsuoka | |
| 2012/0244756 | A1 | 9/2012 | Jouas et al. | |
| 2013/0252488 | A1* | 9/2013 | Ito | H01R 43/28 439/877 |
| 2013/0252489 | A1* | 9/2013 | Kumakura | H01R 4/10 439/878 |
| 2015/0325929 | A1* | 11/2015 | Okura | H01R 43/28 439/444 |
| 2017/0179637 | A1* | 6/2017 | Nakata | H01R 4/188 |

FOREIGN PATENT DOCUMENTS

| | | |
|---|---|---|
| CN | 201063378 | 5/2008 |
| CN | 202855982 | 4/2013 |
| JP | S15-000085 | 1/1940 |
| JP | 2005-050736 | 2/2005 |
| JP | 2015-056209 | 3/2015 |

OTHER PUBLICATIONS

Written Opinion issued in International Patent Application No. PCT/JP2019/003564, dated Mar. 19, 2019, together with English translation thereof.

* cited by examiner

ELECTRICAL CABLE INCLUDING TERMINAL HAVING PRESSING PORTION THAT PRESSES HOLDING PORTION

TECHNICAL FIELD

The technology described herein relates to an electric cable including a terminal including an electric wire and a terminal.

BACKGROUND ART

A terminal connected with a portion of a core wire exposed at an end of an electric cable has been known. The terminal includes a crimping portion that is crimped on the portion of the core wire exposed at the end of the electric cable from an outer side.

To crimp the terminal to the electric cable, the following steps may be performed. First, the terminal is prepared in a predefined shape by pressing sheet metal. Next, the terminal is placed on a holding portion of a lower die of a pair of dies that are movable relative to each other in the vertical direction. Then, the portion of the core wire exposed at the end of the electric cable is placed over the crimping portion of the terminal. After that, one of the dies or both dies are moved in a direction to approach each other until the crimping portion is pressed between a crimping portion of the upper die and the holding portion of the lower die so that the crimping portion is crimped to the portion of the core wire of the electric cable. Through the steps, the terminal is connected with the end of the electric wire (see PATENT DOCUMENT 1).

RELATED ART DOCUMENT

Patent Document

[Patent Document 1]
Japanese Unexamined Patent Application Publication 2005-50736

SUMMARY OF THE INVENTION

Problem to be Solved by the Invention

In recent years, a reduction in weight of a wire harness including terminals and electric wires. For the reduction, a reduction in diameter of the electric wires is considered. If diameters of the electric wires are simply reduced without changing a conductive material of the electric wires, sufficient strength may not be achieved for the electric wires. Therefore, the reduction in diameter of the electric wires with a conductive material having higher strength is considered.

If the conductive material having higher strength is used for the electric wires, the terminals may be deformed during connecting of the terminals with the electric wires due to the increase in strength of the conductive material for the electric wires in comparison to strength of the terminals. If the terminals are deformed, the terminal may not be able to hold the electric wires with sufficient forces.

The technology described herein was made in view of the above circumstances. An object is to provide an electric cable including a terminal in which the terminal holds an electric wire with an increased force.

Means for Solving the Problem

An electric cable including a terminal according to the technology described herein includes an electric wire and a terminal. The terminal includes a holding portion holding the electric wire and a pressing portion pressing the holding portion toward the electric wire. One of the electric wire and the holding portion includes a protrusion protruding toward another one of the electric wire and the holding portion. The other one of the electric wire and the holding portion includes a recess in which the protrusion is fitted.

According to the configuration, when a force is applied to the electric wire, the protrusion of one of the electric wire and the holding portion is fitted in the other one of the electric wire and the holding portion. The force applied to the electric wire is received by the terminal via the protrusion and the recess. According to the configuration, a holding force for holding the terminal on the electric wire can be increased.

Following embodiments according to the technology described herein may have preferred configurations.

The holding portion may include a retaining section at a position different from the protrusion or the recess to hold the electric wire.

The terminal may include a connector coupled to the holding portion and configured to be connected with a meting terminal. The retaining section may be between the connector and the protrusion or the recess.

According to the configurations, the electric wire is further held by the retaining section. Therefore, the holding force for holding the terminal on the electric wire can be further increased.

The terminal may include a window through which the end of the electric wire is detectable. The window is at a position corresponding to an end of the electric wire.

According to the configuration, displacement of the electric wire relative to the terminal in a longitudinal direction of the electric wire can be reduced by placing the end of the electric wire at a position visible through the window. Accuracy in positioning of the protrusion relative to the recess improves. This properly increases the holding force for holding the terminal on the electric wire.

The end of the electric wire may include a marker. The marker may be formed on a side of the electric wire on which the protrusion or the recess is formed.

According to the configuration, accuracy in positioning of the protrusion relative to the recess in a circumferential direction of the electric wire by adjusting an orientation of the electric wire so that the marker faces the holding portion during connection of the electric wire with the terminal. This further increases the holding force for holding the terminal on the electric wire.

The protrusion or the recess may be included in a bent section of the electric wire.

According to the configuration, the recess or the protrusion can be formed by bending the electric wire, which is a simple method.

According to the technology described herein, the holding force for holding the terminal on the electric wire can be increased.

MODES FOR CARRYING OUT THE INVENTION

First Embodiment

A first embodiment to which the technology described herein is applied will be described with reference to FIGS. 1 to 8. An electric cable 10 including a terminal according to this embodiment includes an electric wire 11 and a female terminal 12 (an example of a terminal) connected with the electric wire 11. In the following description, a Z-axis direction heads for the top, a Y-axis direction heads for the front, and an X-axis direction heads for the left. Some of components having the same configuration may be indicated by symbols and others may not be indicated by the symbols.

Electric Wire 11

Figure 2:
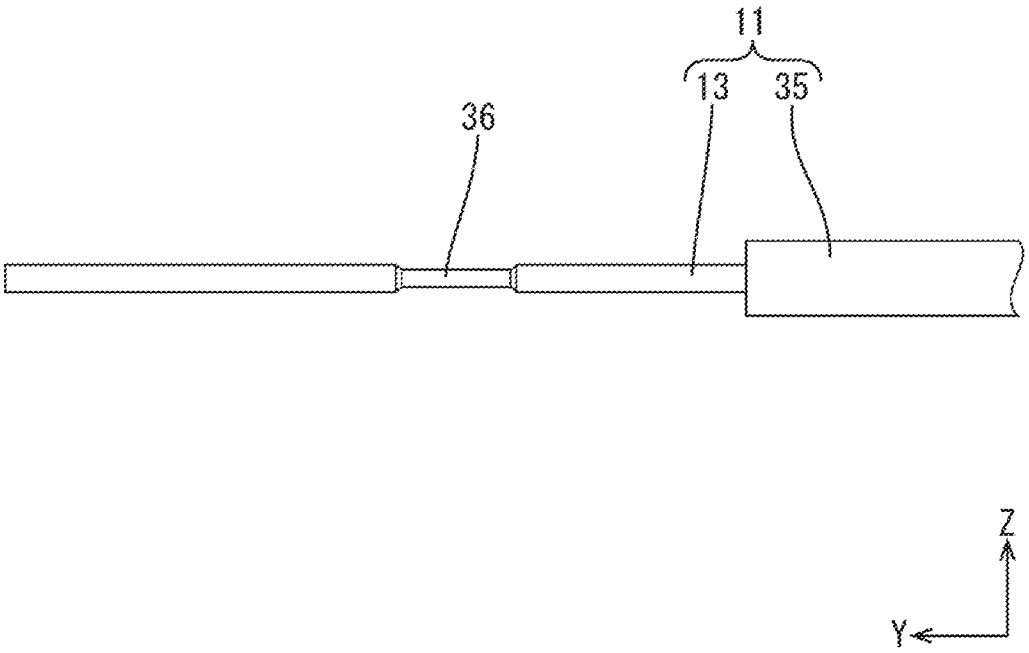
FIG. 2 is a side view of the electric cable.

As illustrated in FIG. 2, the electric wire includes a core wire 13 and an insulating sheath 35 that is made of synthetic resin having insulating properties. The insulating sheath 35 covers a periphery of the core wire. The core wire 13 has a round cross section. The core wire 13 is made of metal selected from copper, copper alloy, aluminum, aluminum alloy, and any other appropriate metal. The core wire 13 in this embodiment is made of copper or copper alloy. The core wire 13 may be a stranded wire including metal wires or a solid wire including a single metal rod. The core wire 13 in this embodiment is a solid wire.

At an end of the electric wire 11, a section of the insulating sheath 35 is stripped and a section of the core wire 13 is exposed. The exposed section of the core wire 13 includes a recess 36 (an example of a recess) at the middle of the exposed section in a longitudinal direction of the core wire 13. The recess 36 has a diameter reduced from a diameter of the core wire 13 in a radial direction of the core wire 13. The recess 36 is formed for an entire periphery of the core wire 13.

Female Terminal 12

Figure 1:
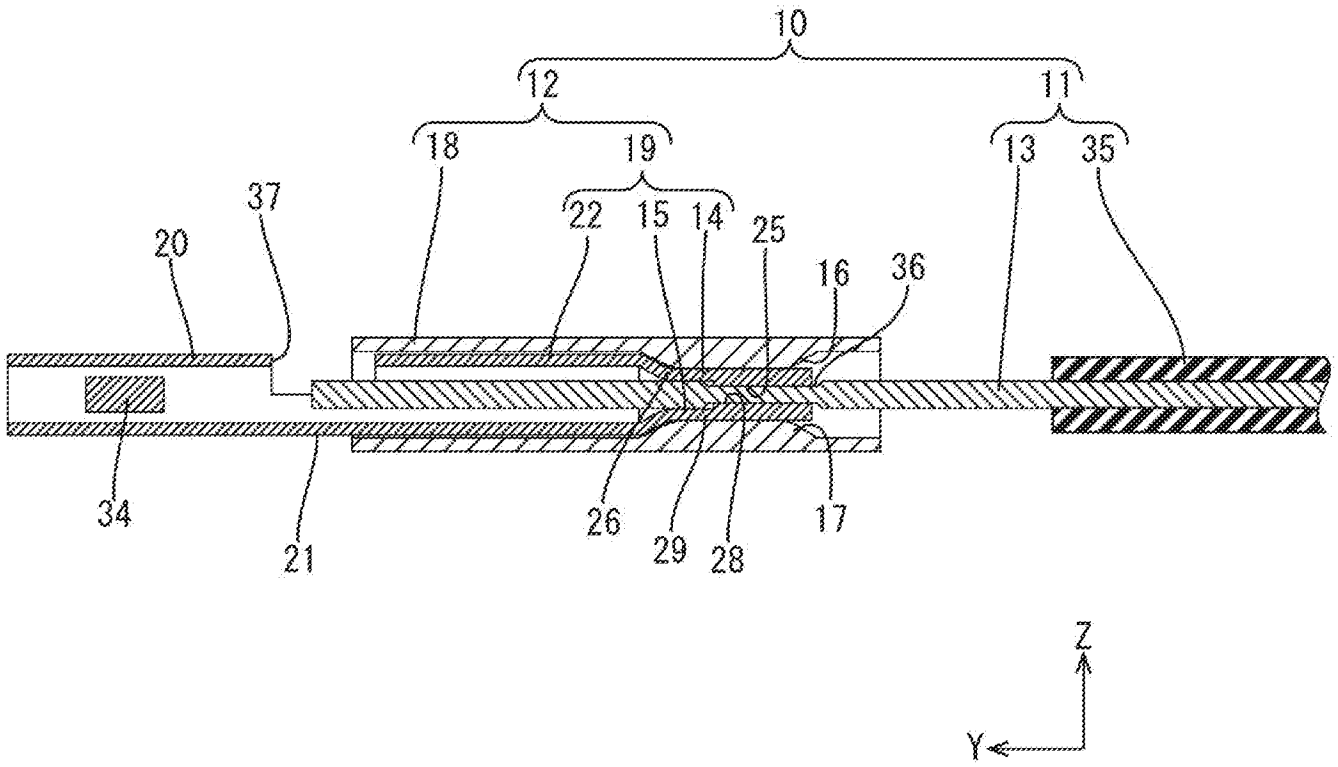
FIG. 1 is a cross-sectional view of an electric wire including a terminal according to a first embodiment.

As illustrated in FIG. 1, the female terminal 12 includes an electric wire connector 19 and a slider 18. The electric wire connector 19 includes a first holding portion 14 (an example of a holding section) and a second holding portion 15 (an example of a holding section). The first holding portion 14 and the second holding portion 15 sandwich the core wire 13 of the electric wire 11. The slider 18 includes a first pressing portion 16 (an example of a pressing portion) and a second pressing portion 17 (an example of a pressing portion). The first pressing portion 16 and the second pressing portion 17 press the first holding portion 14 and the second holding portion 15 toward the core wire 13.

The female terminal 12 is made of a metal material having conductivity. Metal of the terminal may be selected from copper, copper alloy, aluminum, aluminum alloy, and any appropriate metal where appropriate. The terminal in this embodiment is made of copper or copper alloy. The female terminal 12 may be prepared by a known method including cutting, casting, and pressing.

The female terminal 12 includes a connecting tube portion 20 (an example of a connecting portion) in which a male terminal, which is not illustrated, is to be inserted. The connecting tube portion 20 has a rectangular tube shape that extends in a front-rear direction. The connecting tube portion 20 has openings on the front and the rear. An elastic connecting member 34 is disposed inside the connecting tube portion 20 to contact the male terminal with an elastic force. Through contact between the elastic connecting member 34 and the male terminal with the elastic force, electric connection is established between the male terminal and the female terminal 12.

An extending portion 21 extends rearward from a rear end of the connecting tube portion 20. The electric wire connector 19 extends from a rear end of the extending portion 21. The electric wire connector 19 includes a base portion 22, the first holding portion 14, and the second holding portion 15. The first holding portion 14 and the second holding portion 15 extend from a rear end of the base portion 22.

An upper surface of the extending portion 21 includes a window 37 that opens upward. The end of the core wire 13 disposed inside the extending portion 21 and exposed through the window 37 is detectable from above. Detectable means that the end of the core wire 13 is viewable or electrically detectable using a probe inserted through the window 37.

The base portion 22 has a rectangular tube shape that extends in the front-rear direction. The base portion 22 includes openings on the front and the rear. Fitting projections 23 protrude leftward from a left wall of the base portion 22 and rightward from a right wall of the base portion 22 (see FIGS. 3 and 4).

Figure 5:
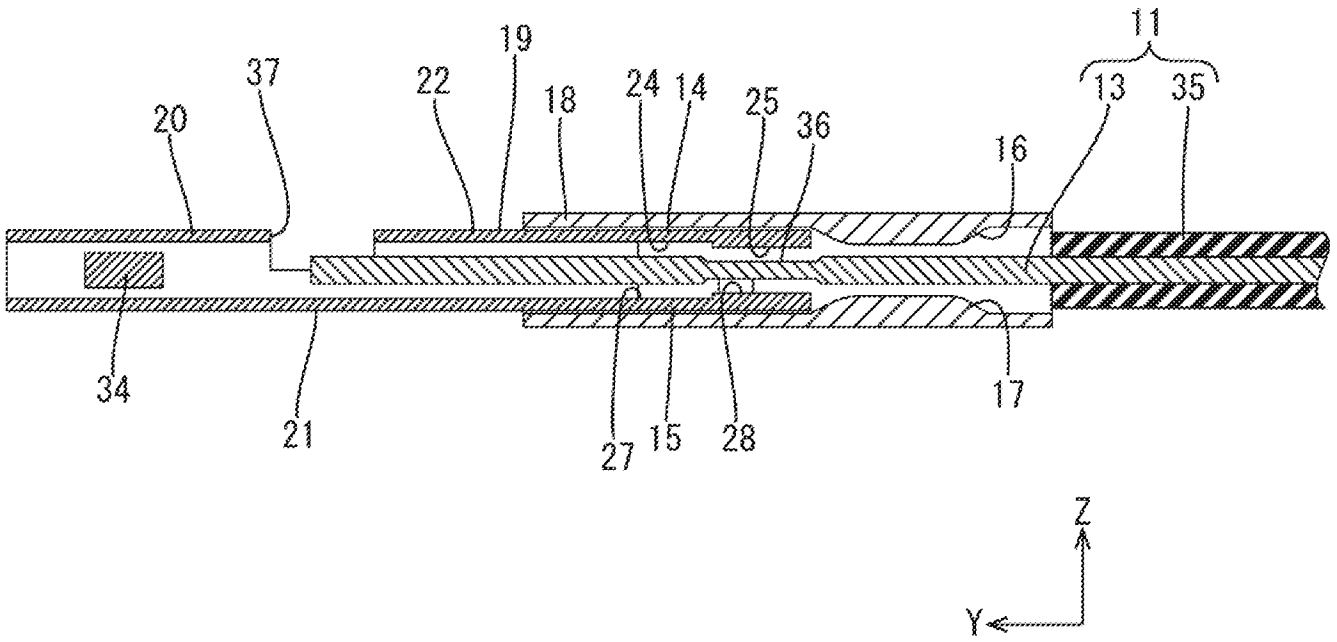
FIG. 5 is a cross-sectional view illustrating the electric wire inserted in the female terminal with the slider held to the electric wire connector at the temporary holding position.
Figure 6:
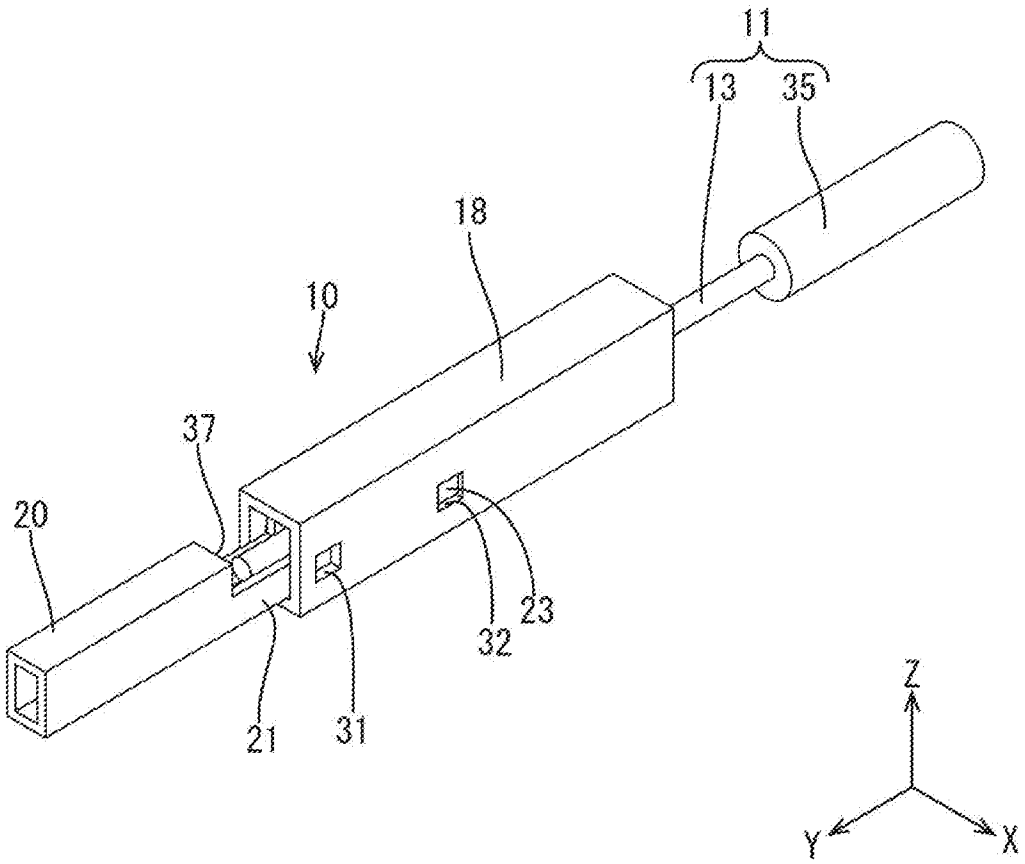
FIG. 6 is a perspective view illustrating the electric wire inserted in the female terminal with the slider held to the electric wire connector at a permanent holding position.
Figure 7:
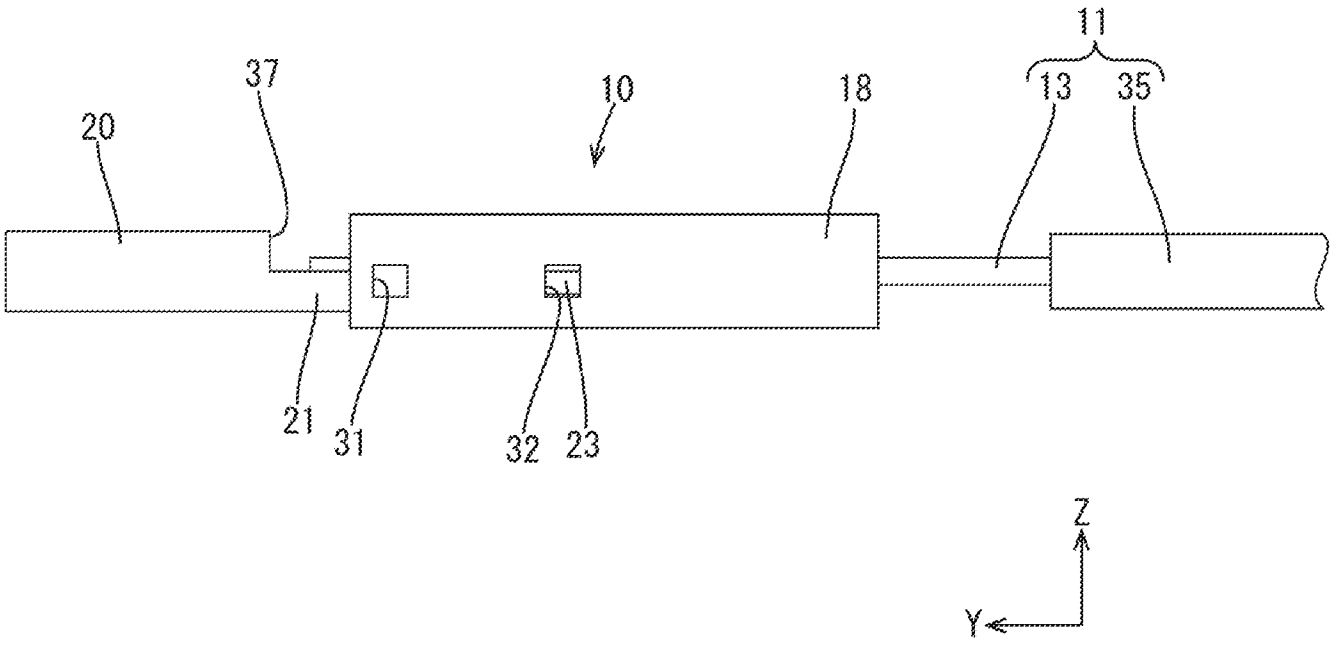
FIG. 7 is a side view illustrating the electric wire inserted in the female terminal with the slider held to the electric wire connector at the permanent holding position.

As illustrated in FIG. 5, the first holding portion 14 extends rearward from a rear end of an upper wall of the base portion 22. The first holding portion 14 has a plate shape elongated in the front-rear direction. The first holding portion 14 is flexible in a thickness direction (the vertical direction). A lower surface of the first holding portion 14 is defined as a first contact surface 24 that contacts the core wire 13. A first protrusion 25 (an example of a protrusion) protrudes downward from the first contact surface 24 at a position closer to the rear end of the first holding portion 14.

As illustrated in FIG. 5, the second holding portion 15 extends rearward from a rear end of a lower wall of the base portion 22. The second holding portion 15 has a plate shape elongated in the front-rear direction. The second holding portion 15 is flexible in a thickness direction (the vertical direction). An upper surface of the second holding portion 15 is defined as a second contact surface 27 that contacts the core wire 13. A second protrusion 28 (an example of a protrusion) protrudes upward from the second contact surface 27 of the second holding portion 15 at a position corresponding to the first protrusion 25 of the first holding portion 14.

Figure 8:
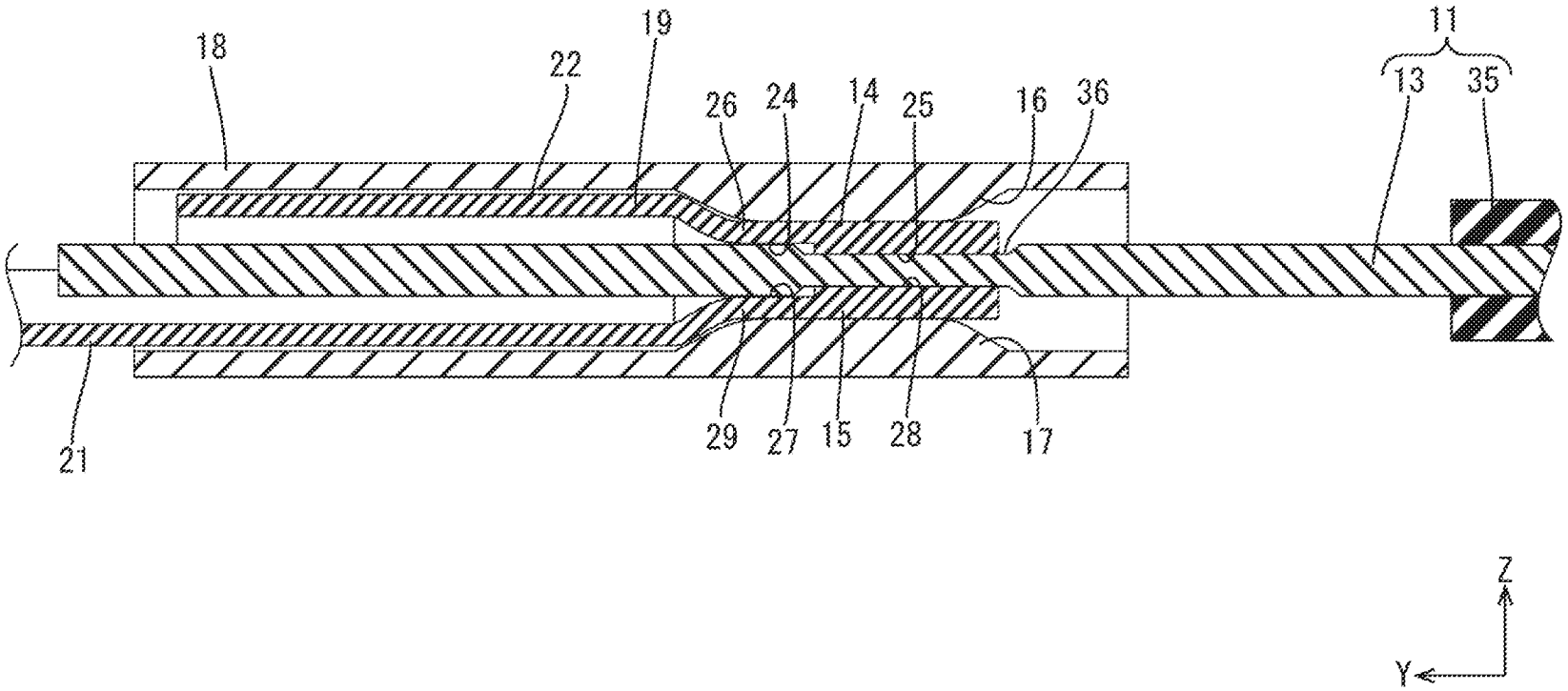
FIG. 8 is a magnified partial cross-sectional view illustrating connection between the electric wire and the female terminal.

As illustrated in FIG. 8, the first protrusion 25 and the second protrusion 28 are disposed inside the recess 36 of the core wire 13 that is sandwiched between the first holding portion 14 and the second holding portion 15.

As illustrated in FIG. 8, the first holding portion 14 includes a first retaining section 26 at a position more to the front than the first protrusion 25 and more to the rear than the connecting tube portion 20. The first retaining section 26 contacts a section of the core wire 13 more to the front than the recess 36. The second holding portion 15 includes a second retaining section 29 at a position more to the front than the second protrusion 28 and more to the rear than the connecting tube portion 20. The second retaining section 29 contacts a section of the core wire 13 more to the front than the recess 36. Namely, the first retaining section 26 is located between the connecting tube portion 20 and the first protrusion 25 in a section of the first holding portion 14 other than the first protrusion 25. The second retaining section 29 is located between the connecting tube portion 20 and the second protrusion 28 in a section of the second holding portion 15 other than the second protrusion 28. With the first retaining section 26 and the second retaining section 29, the core wire 13 is held from top and bottom. The core wire 13 is electrically connected to the first retaining section 26 and the second retaining section 29 that sandwich the core wire 13 between the first retaining section 26 and the second retaining section 29.

Slider 18

As illustrated in FIG. 5, the slider 18 has a rectangular tube shape elongated in the front-rear direction. The slider 18 includes openings on the front and the rear. The opening of the slider 18 on the front has an outer dimension equal to or slightly larger than an outer dimension of the electric wire connector 19 so that the electric wire connector 19 can be inserted into the slider 18. The slider 18 is made of any appropriate material such as metal, synthetic resin, and ceramic. The metal of the slider 18 may be selected from copper, copper alloy, aluminum, aluminum alloy, and stainless steel where appropriate. If the slider 18 is made of metal, the slider 18 may be prepared by an appropriate known method such as cutting, casting, and pressing.

Figure 3:
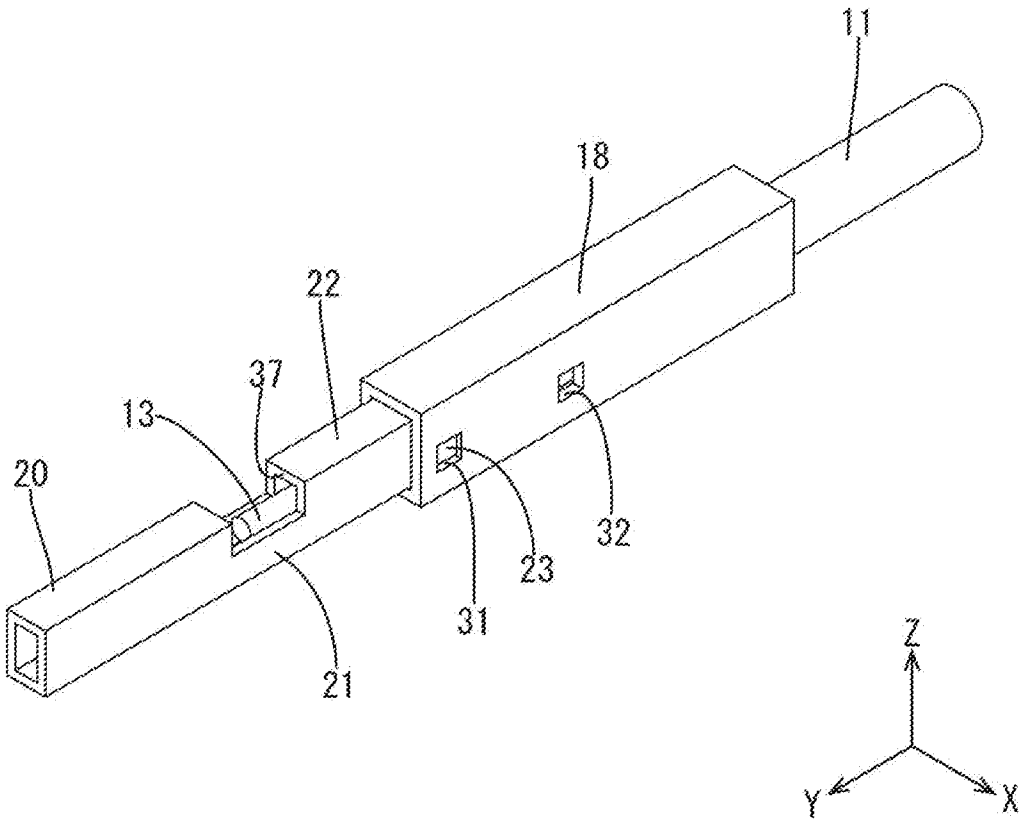
FIG. 3 is a perspective view illustrating an electric wire inserted in a female terminal with a slider held to an electric wire connector at a temporary holding position.
Figure 4:
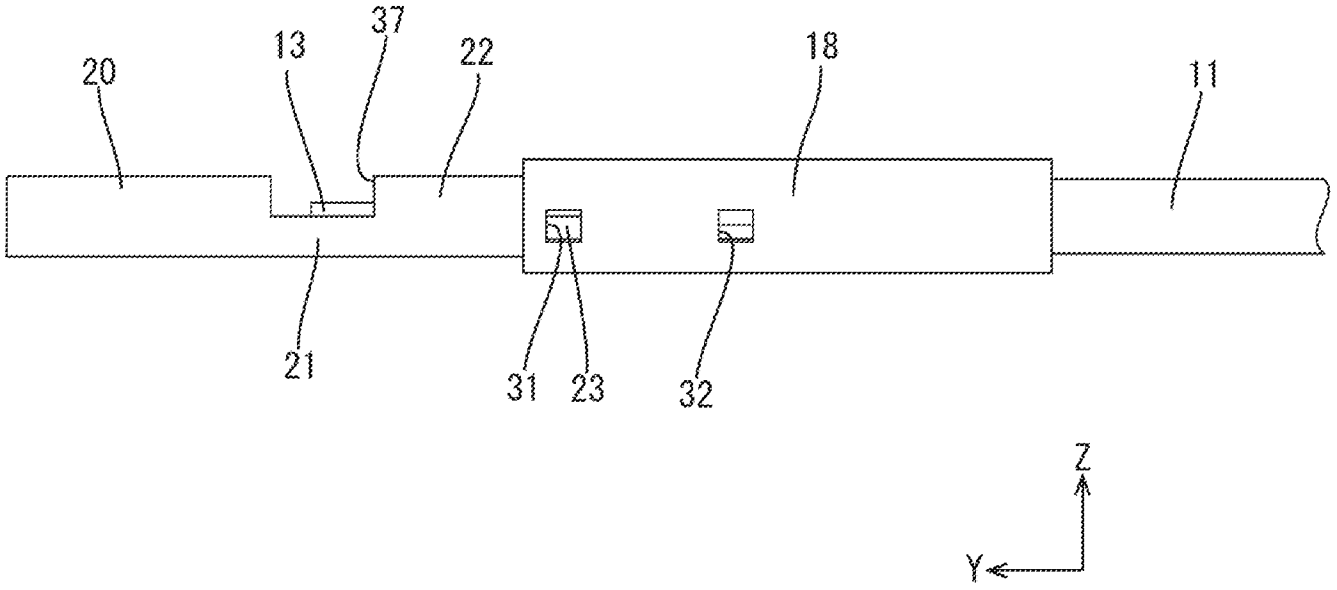
FIG. 4 is a side view illustrating the electric wire inserted in the female terminal with the slider held to the electric wire connector at the temporary holding position.

As illustrated in FIGS. 3 and 4, the slider 18 includes temporary holders 31 in the right wall and the left wall of the slider 18 at positions closer to the front edge of the slider 18. The fitting projections 23 are fitted in the temporary holders 31 with elastic forces to hold the slider 18 to the electric wire connector 19 at a temporary holding position. The temporary holders 31 are through holes in the right wall and the left wall of the slider 18. A size of each temporary holder 31 is equal to or slightly larger than a size of each fitting projection 23 so that the fitting projection 23 can be inserted into the temporary holder 31.

The slider 18 includes permanent holders 32 in the right wall and the left wall at positions more to the rear than the temporary holders 31. The fitting projections 23 are fitted in the permanent holders 32 with elastic forces to hold the slider 18 to the electric wire connector 19 at a permanent holding position. The permanent holders 32 are through holes in the right wall and the left wall of the slider 18. A size of each permanent holder 32 is equal to or slightly larger than the size of each fitting projection 23 so that the fitting projection 23 can be fitted in the permanent holder 32.

As illustrated in FIG. 5, the slider 18 includes a first pressing portion 16 (an example of a pressing portion) at a position slightly more to the rear than the middle in the front-rear direction. The first pressing portion 16 protrudes downward from a lower surface of the upper wall of the slider 18 and extends in the front-rear direction. A rear end of the first pressing portion 16 is located at a position slightly more to the front than the rear edge of the slider 18.

The slider 18 includes the second pressing portion 17 (an example of a pressing portion) at a position slightly more to the rear than the middle in the front-rear direction. The second pressing portion 17 protrudes upward from an upper surface of the lower wall of the slider 18 and extends in the front-rear direction. A rear end of the second pressing portion 17 is located at a position slightly more to the front than the rear edge of the slider 18.

At Temporary Holding Position

The slider 18 held to the electric wire connector 19 at a temporary holding position is illustrated in FIGS. 3 to 5. The fitting projections 23 of the electric wire connector 19 are fitted in the temporary holders 31 of the slider 18. When the slider 18 is held to the electric wire connector 19 at the temporary holding position, a front half of the slider 18 is fitted on about two-third of the electric wire connector 19 from the rear edge of the electric wire connector 19 in the front-rear direction.

As illustrated in FIG. 5, at the temporary holding position, the rear edge of the first holding portion 14 is located more to the front than the front edge of the first pressing portion 16. The rear edge of the second holding portion 15 is located more to the front than the front edge of the second pressing portion 17. Namely, the first holding portion 14 does not contact the first pressing portion 16 and the second holding portion 15 does not contact the second pressing portion 17 at the temporary holding position.

As illustrated in FIG. 5, the core wire 13 is inserted into a space between the first holding portion 14 and the second holding portion 15 through the opening of the slider 18 on the rear. When the core wire 13 is inserted in the female terminal 12, the front end of the core wire 13 is visible through the window 37. When the front end of the core wire 13 is located between the front edge and the rear edge of the window 37, the first protrusion 25 and the second protrusion 28 of the female terminal 12 are located at positions corresponding to the recess 36 of the core wire 13.

At Permanent Holding Position

The slider 18 held to the electric wire connector 19 at the permanent holding position is illustrated in FIGS. 1 and 6 to 8. The fitting projections 23 of the electric wire connector 19 are fitted in the permanent holders 32 of the slider 18. When the slider 18 is held to the electric wire connector 19 at the permanent holding position, the slider 18 entirely covers the electric wire connector 19 in the front-rear direction. The front edge of the slider 18 is located more to the front than the front edge of the electric wire connector 19. The rear edge of the slider 18 is located more to the rear than the rear edge of the electric wire connector 19.

As illustrated in FIG. 8, the first pressing portion 16 contacts the upper surface of the first holding portion 14 (a surface on an opposite side from the first contact surface 24) from above. Therefore, the first holding portion 14 bends downward and contacts the core wire 13 from above.

The second pressing portion 17 contacts the lower surface of the second holding portion 15 (a surface on an opposite side from the second contact surface 27) from below. Therefore, the second holding portion 15 bends upward and contacts the core wire 13 from below.

The first holding portion 14 is pressed by the first pressing portion 16 from above and the second holding portion 15 is pressed by the second pressing portion 17 from below. As a result, the core wire 13 disposed between the first holding portion 14 and the second holding portion 15 is sandwiched between the first holding portion 14 and the second holding portion 15. According to the configuration, the electric wire 11 is electrically connected to the female terminal 12.

As illustrated in FIG. 8, the first protrusion 25 is disposed inside the recess 36 of the core wire 13. Sections of the inner surface of the recess 36 are located more to the front and more to the rear than the first protrusion 25 in the longitudinal direction of the electric wire 11 (the front-rear direction). The second protrusion 28 is disposed inside the recess 36 of the core wire 13. Sections of the inner surface of the recess 36 are located more to the front and more to the rear than the second protrusion 28 in the longitudinal direction of the electric wire 11 (the front-rear direction). The sections of the inner surface of the recess 36 are formed in a direction crossing an outer periphery of the core wire 13.

Example of Process for Connecting Female Terminal 12 to Electric Wire 11

Next, an example of a process for connecting the female terminal 12 to the electric wire 11. The process for connecting the female terminal 12 to the electric wire 11 is not limited to the process described below.

The slider 18 is fitted on the electric wire connector 19 of the female terminal 12 from the rear. The rear end of the electric wire connector 19 of the female terminal 12 is inserted in the opening of the slider 18 on the front and the slider 18 is moved frontward. When the fitting projections 23 of the electric wire connector 19 contact a hole edge of the opening of the slider 18 on the front from the front, the right wall and the left wall of the electric wire connector 19 elastically deform inward. When the slider 18 is further moved frontward, the fitting projections 23 are fitted in the temporary holders 31 and the right wall and the left wall of the electric wire connector 19 recover from the elastic deformation. The fitting projections 23 contact the hole edges of the temporary holders 31 from the front or the rear and the slider 18 is held to the electric wire connector 19 at the temporary holding position (see FIGS. 5 to 7).

The insulating sheath 35 is stripped at the end of the electric wire 11 so that the section of the core wire 13 is exposed. The exposed section of the core wire 13 is inserted in the opening of the slider 18 on the rear. The section of the core wire 13 is further inserted to the front until the front end of the core wire 13 is located inside the window 37 in the extending portion 21. By viewing the extending portion 21 from above, the location of the front end of the core wire 13 in the window 37 can be confirmed (see FIG. 3).

When the slider 18 is moved frontward, the right wall and the left wall of the slider 18 move over the fitting projections 23 of the electric wire connector 19. The right wall and the left wall of the electric wire connector 19 elastically deform inward in the horizontal direction. When the slider 18 is further moved frontward, the first pressing portion 16 contacts the upper surface of the first holding portion 14 from above and the second pressing portion 17 contacts the lower surface of the second holding portion 15 from below.

When the slider 18 is further moved frontward, the first pressing portion 16 presses the first holding portion 14 downward and the second pressing portion 17 pressed the second holding portion 15 upward. As a result, the first holding portion 14 deforms downward and the second holding portion 15 deforms upward. As a result, the section of the core wire 13 is sandwiched between the first holding portion 14 and the second holding portion 15.

When the slider 18 is further moved frontward, the fitting projections 23 are fitted in the permanent holders 32 and the right wall and the left wall of the electric wire connector 19 recover from the elastic deformation. As a result, the fitting projections 23 contact hole edges of the permanent holders 32 from the front or the rear and the slider 18 is held to the electric wire connector 19 at the permanent holding position (see FIGS. 1 and 6 to 8). This complete the process for connecting the female terminal 12 to the electric wire 11 and the electric cable 10 including the terminal is complete.

Effects of this embodiment will be described. The electric cable 10 including the terminal according to this embodiment includes the electric wire 11 and the female terminal 12. The female terminal 12 includes the first holding portion 14 and the second holding portion 15 that sandwich the electric wire 11. The female terminal 12 further includes the first pressing portion 16 and the second pressing portion 17 that press the first holding portion 14 and the second holding portion 15 toward the electric wire 11. The first holding portion 14 and the second holding portion 15 of the electric cable 10 including the terminal include the first protrusion 25 and the second protrusion 28, respectively. The first protrusion 25 and the second protrusion 28 protrude toward the electric wire 11. The core wire 13 of the electric wire 11 includes the recess 36 in which the first protrusion 25 and the second protrusion 28 are fitted.

According to the configuration, when a force is applied to the electric wire 11, the first protrusion 25 of the first holding portion 14 and the second protrusion 28 of the second holding portion 15 are fitted in the recess 36 of the electric wire 11 in the longitudinal direction of the electric wire 11. The force applied to the electric wire 11 is received by the female terminal 12 via the first protrusion 25, the second protrusion 28, and the recess 36. Therefore, the holding force for holding the female terminal 12 on the electric wire 11 can be increased.

According to this embodiment, the first holding portion 14 and the second holding portion 15 include the first retaining section 26 and the second retaining section 29 for sandwiching the section of the core wire 13 of the electric wire 11 at the positions different from the first protrusion 25 and the second protrusion 28.

According to this embodiment, the female terminal 12 includes the connecting tube portion 20 that is coupled to the first holding portion 14 and the second holding portion 15. The connecting tube portion 20 is to be connected to a mating terminal. The first retaining section 26 is between the connecting tube portion 20 and the first protrusion 25. The second regaining section 29 is between the connecting tube portion 20 and the second protrusion 28.

According to the configuration, the electric wire 11 is further held by the first retaining section 26 and the second retaining section 29. Therefore, the holding force for holding the female terminal 12 on the electric wire 11 can be further increased. Further, the electrical connection between the female terminal 12 and the electric wire 11 is further ensured.

According to this embodiment, the female terminal 12 includes the window 37 at the position corresponding to the front end of the core wire 13 of the electric wire 11 so that the front end of the core wire 13 is detectable.

According to the configuration, the front end of the core wire 13 of the electric wire 11 is disposed at the position detectable by viewing or with an electrical device such as a probe to reduce displacement of the core wire 13 relative to the female terminal 12 in the longitudinal direction of the electric wire 11. According to the configuration, accuracy in positioning of the first protrusion 25 and the second protrusion 28 relative to the recess 36 can be improved. This properly increases the holding force for holding the female terminal 12 on the electric wire 11.

Second Embodiment

A second embodiment of the technology described herein will be described with reference to FIGS. 9 to 13. An electric cable 50 including a terminal according to this embodiment includes an electric wire 51 and a female terminal 59.

Electric Wire 51

Figure 9:
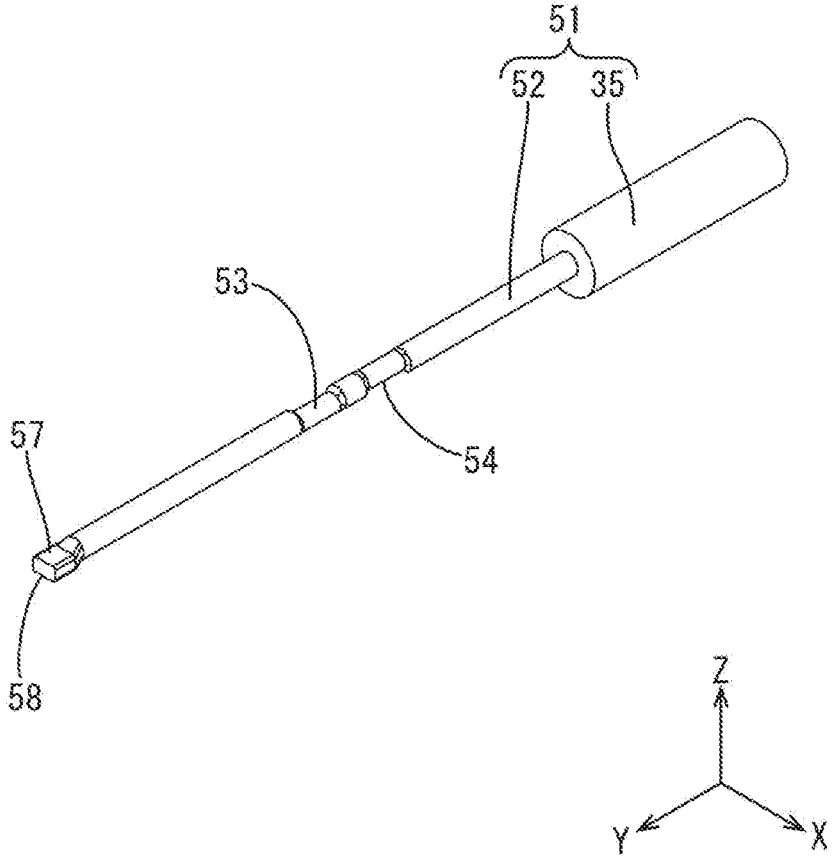
FIG. 9 is a perspective view of an electric cable according to a second embodiment.
Figure 10:
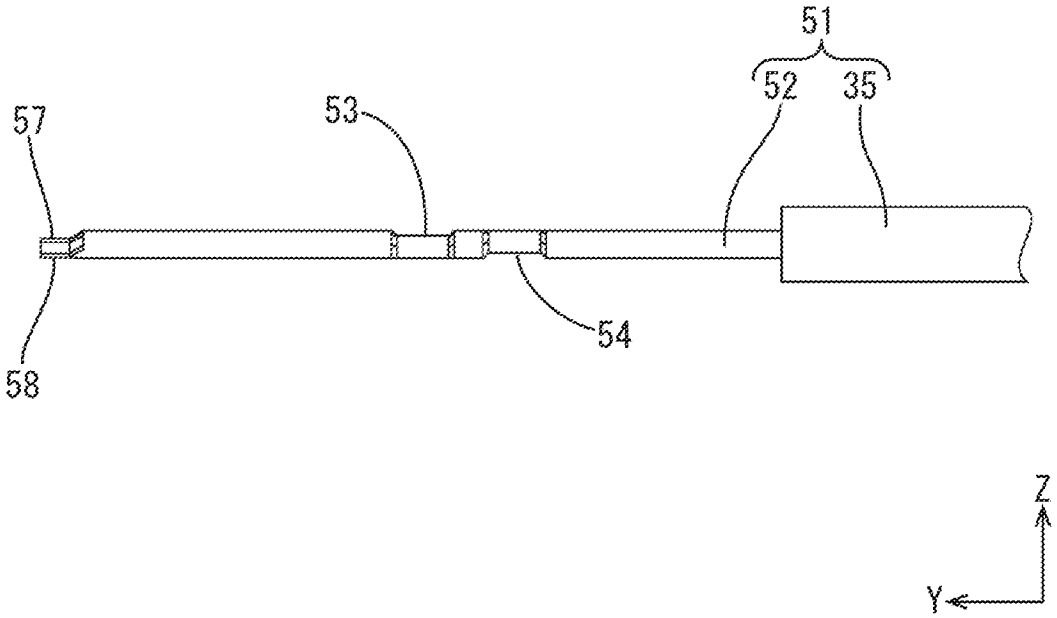
FIG. 10 is a side view of the electric cable.

As illustrated in FIGS. 9 and 10, a core wire 52 of the electric wire 51 includes a first recess 53 (an example of a recess) and a second recess 54 (an example of a recess) separated from the first recess 53. The second recess 54 is located more to the rear than the first recess 53.

The first recess 53 is formed by reducing a diameter of a portion of the core wire 52 other than a lower portion. The second recess 54 is formed by reducing a diameter of a portion of the core wire 52 other than an upper portion.

A front end of the core wire 52 includes an upper flat surface 57 (an example of a marker) on an upper side of the core wire 52 and a lower flat surface 58 (an example of a marker) on a lower side of the core wire 52. The upper flat surface 57 is located on a side of the core wire 52 in which the first recess 53 is formed. The lower flat surface 58 is located on a side of the core wire 52 in which the second recess 54 is formed.

The upper flat surface 57 and the lower flat surface 58 are formed by pressing the core wire 52. The upper flat surface 57 is at a position slightly below the top of the core wire 52. The lower flat surface 58 is coupled to the bottom of the core wire 52. The front end of the core wire 52 includes the upper flat surface 57 and the lower flat surface 58. The front end of the core wire 52 further includes right and left flat surfaces. The front end of the core wire 52 has an about rectangular shape when viewed from the front. The front end of the core wire 52 has a width measuring in the horizontal direction is slightly larger than a diameter of the core wire 52. The front end of the core wire 52 including the upper flat surface 57 and the lower flat surface 58 may have an oval shape when viewed from the front.

Female Terminal 59

Figure 11:
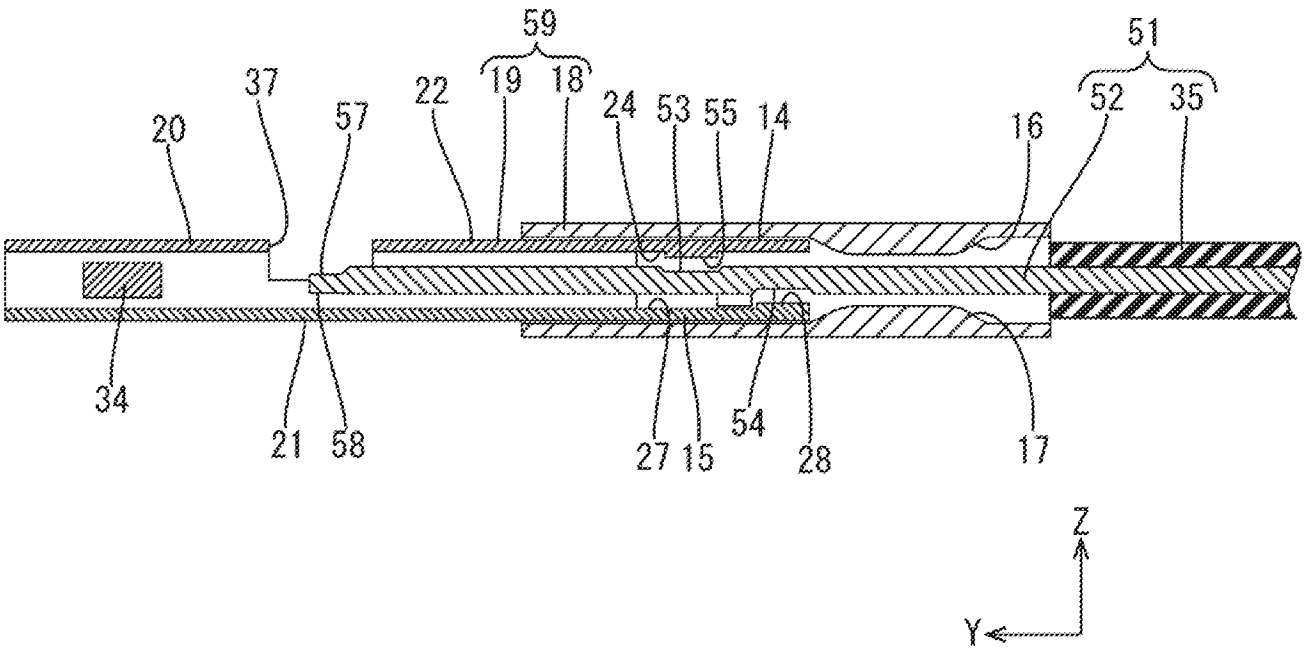
FIG. 11 is a cross-sectional view illustrating an electric wire inserted in a female terminal with a slider held to an electric wire connector at a temporary holding position.

As illustrated in FIG. 11, the female terminal 59 includes a first protrusion 55 (an example of a protrusion) at a position closer to the front edge of the first holding portion 14. The first protrusion 55 protrudes downward from the first contact surface 24. The female terminal 59 includes a second protrusion 56 (an example of a protrusion) at a position closer to the rear edge of the second holding portion. The second protrusion 56 protrudes upward from the second contact surface 27. The first protrusion 55 and the second protrusion 56 are separated from each other in the front-rear direction.

At Temporary Holding Position

As illustrated in FIG. 11, when the slider 18 is held to the electric wire connector 19 at the temporary holding position, the electric wire 51 can be inserted into the female terminal 59 from the rear. The electric wire 51 is inserted into the female terminal 59 with the lower flat surface 58 of the front end of the core wire 52 sliding on the bottom wall of the base portion 22 having a rectangular tube shape. The electric wire 51 is disposed with the upper flat surface 57 of the core wire 52 facing upward. The core wire 52 may be inserted into the female terminal 59 with the right side surface and the left side surface of the front end of the core wire 52 sliding on the right sidewall and the left sidewall of the base portion 22, respectively.

when the front end of the core wire 52 is at a position within the window 37, the first protrusion of the first holding portion 14 is opposed to the first recess 53 of the core wire 52. The second protrusion 56 of the second holding portion 15 is opposed to the second recess 54 of the core wire 52.

At Permanent Holding Position

Figure 12:
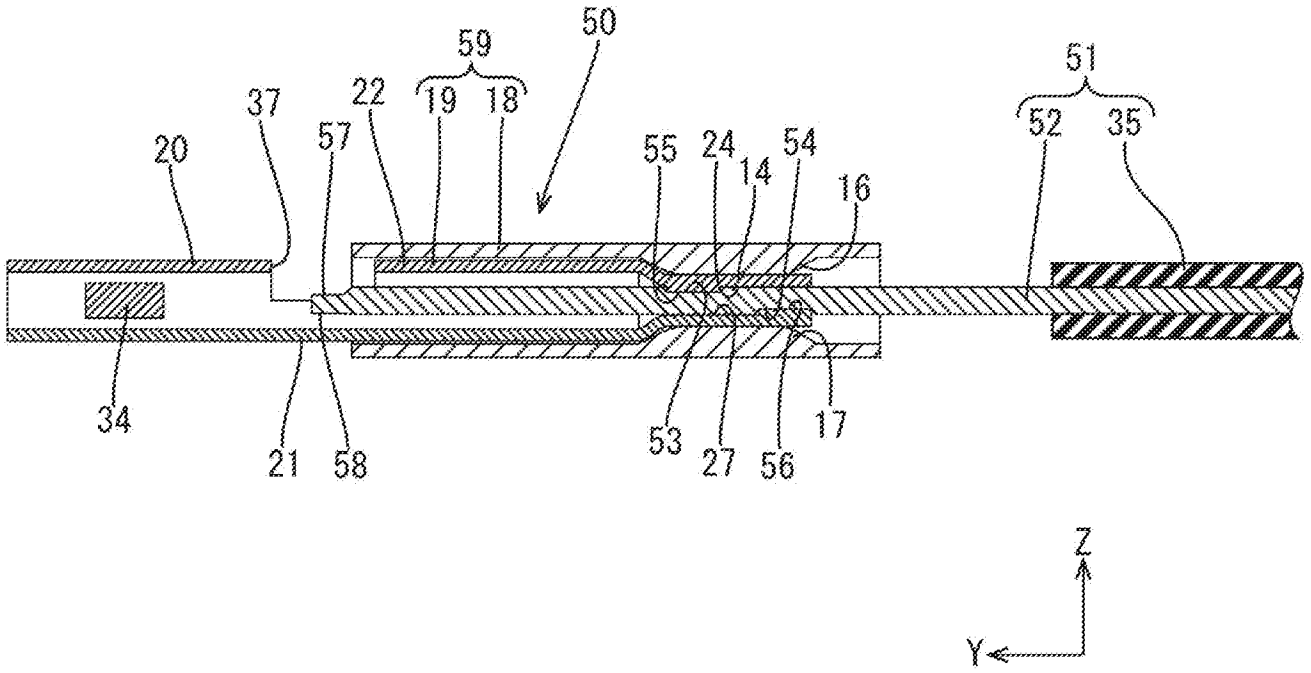
FIG. 12 is a cross-sectional view illustrating the electric wire inserted in the female terminal with the slider held to the electric wire connector at a permanent holding position.
Figure 13:
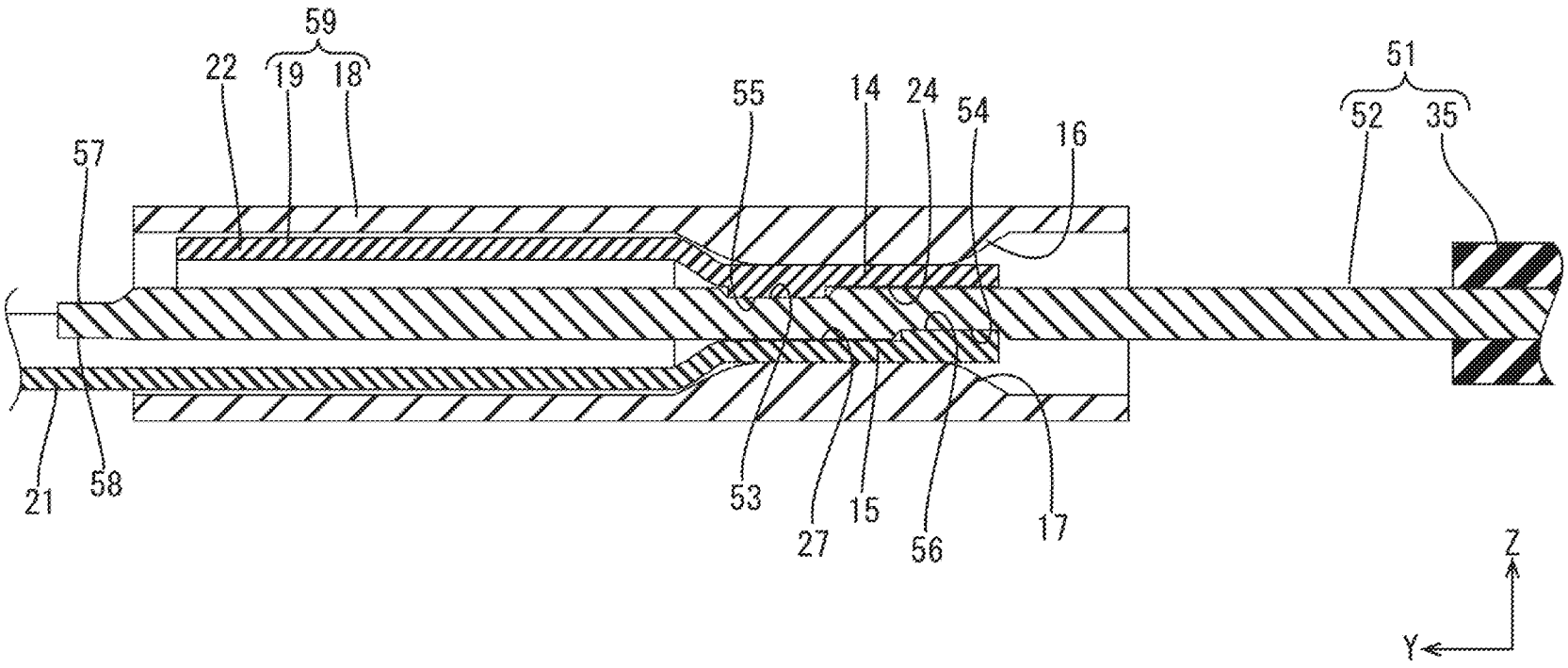
FIG. 13 is a magnified partial cross-sectional view illustrating connection between the electric wire and the female terminal.

As illustrated in FIGS. 12 and 13, when the slider 18 is held to the electric wire connector 19 at the permanent holding position, the first protrusion 55 of the first holding portion 14 is located inside the first recess 53 of the core wire 52. The second protrusion 56 of the second holding portion 15 is located inside the second recess 54 of the core wire 52.

Configurations other than those described above are similar to those of the first embodiment. Components having the same configurations as those of the components of the first embodiment will be indicated by the same symbols and will not be described in detail.

In this embodiment, the end of the electric wire 51 includes the upper flat surface 57 on the side of the electric wire 51 in which the first recess 53 is formed.

According to the configuration, an orientation of the electric wire 51 can be adjusted so that the upper flat surface 57 faces upward when viewed through the window 37 during connection of the electric wire 51 with the female terminal 59. Through the adjustment, accuracy in positioning of the first recess 53 of the electric wire 51 relative to the first protrusion 55 of the first holding portion 14 can be improved. This further increases the holding force for holding the female terminal 59 on the electric wire 51.

Third Embodiment

A third embodiment of the technology described herein will be described with reference to FIGS. 14 to 18. An electric cable 70 including a terminal according to this embodiment includes an electric wire 71 and a female terminal 77.

Electric Wire 71

Figure 14:
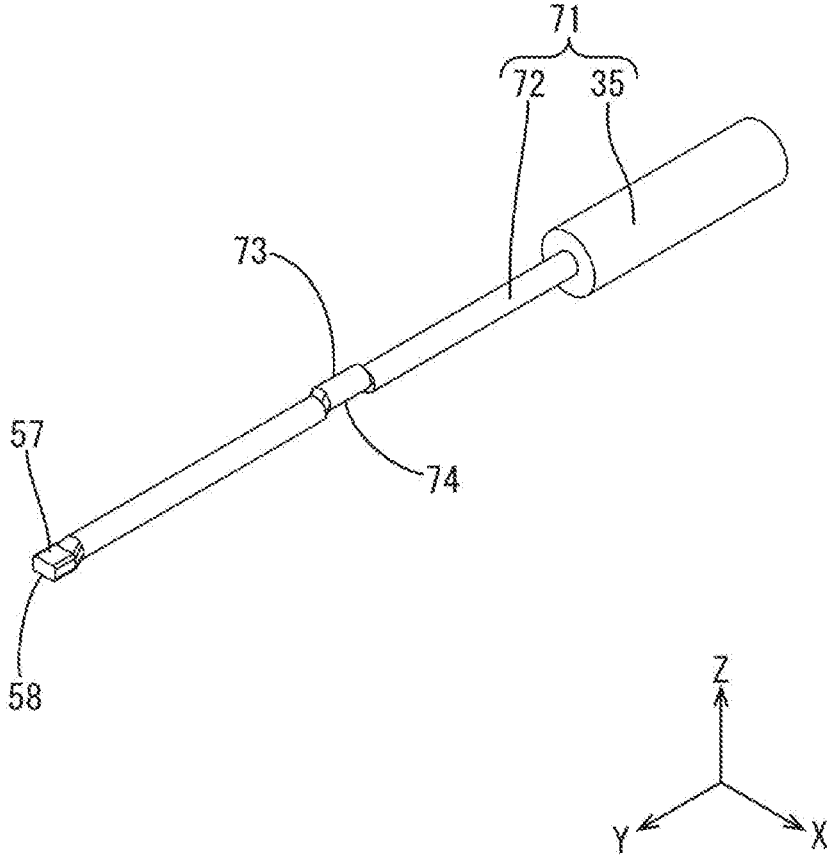
FIG. 14 is a perspective view of an electric cable according to a third embodiment.
Figure 15:
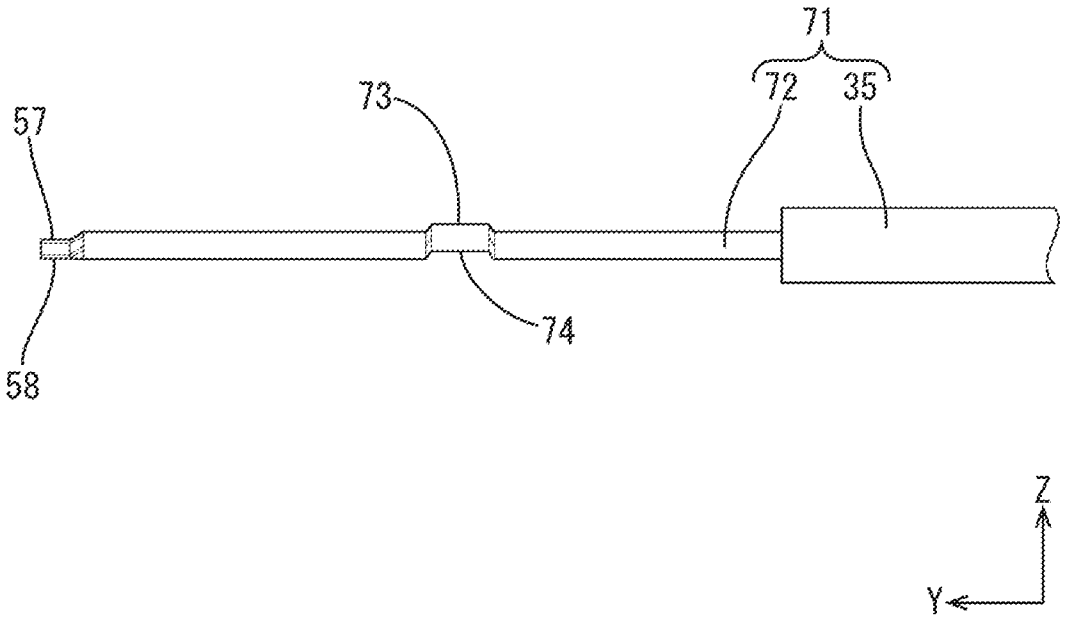
FIG. 15 is a side view of the electric cable.

As illustrated in FIGS. 14 and 15, a core wire 72 of the electric wire 71 includes an exposed portion that is uncovered with the insulating sheath 35. The exposed portion of the core wire 72 includes a middle section that bends to project upward. Specifically, the section of the core wire 72 extending frontward from an edge of the insulating sheath 35 bends upward, frontward, downward, and then frontward. By being bent as such, the core wire 72 includes a first protrusion 73 (an example of a protrusion) and a second recess 74 (an example of a recess). The first protrusion 73 protrudes upward. The second recess 74 is formed under the first protrusion 73.

Female Terminal 77

Figure 16:
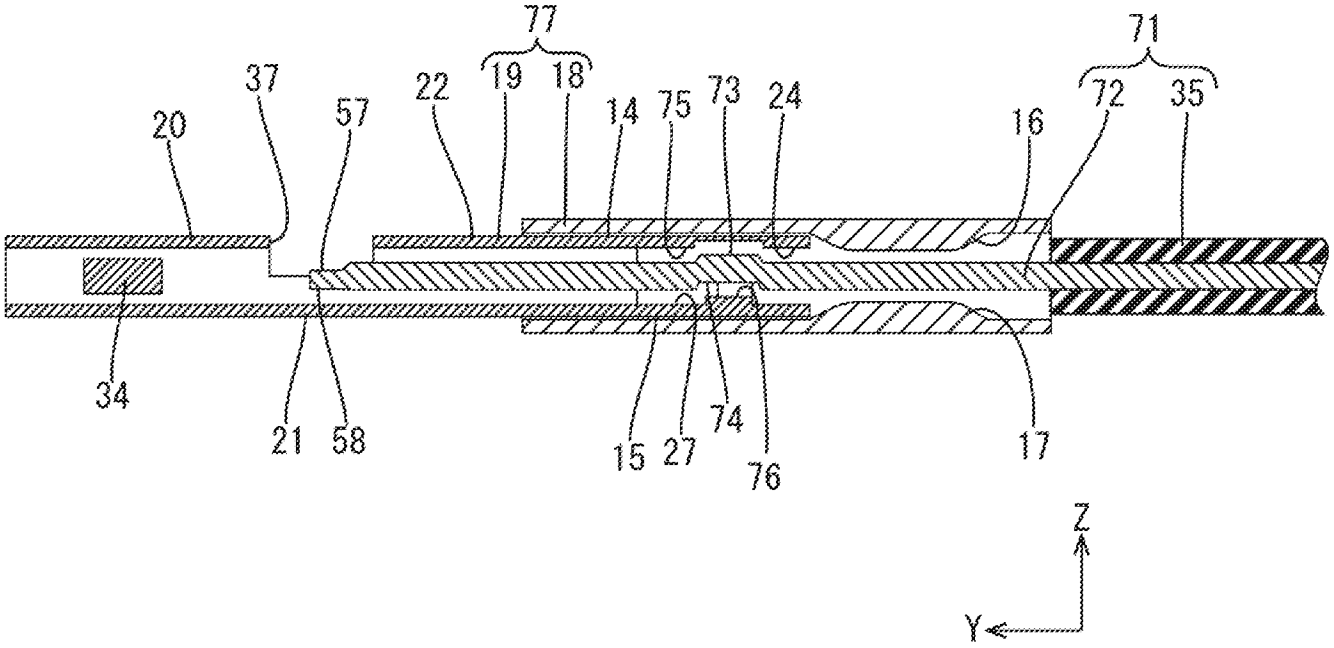
FIG. 16 is a cross-sectional view illustrating an electric wire inserted in a female terminal with a slider held to an electric wire connector at a temporary holding position.

As illustrated in FIG. 16, the female terminal 77 includes a first recess 75 (an example of a recess) about the middle of the first holding portion 14 in the front-rear direction. The first recess 75 is recessed upward from the first contact surface 24. The female terminal 77 includes a second protrusion 76 (an example of a protrusion) about the middle of the second holding portion 15 in the front-rear direction corresponding to the first recess 75. The second protrusion 76 protrudes upward from the second contact surface 27.

At Temporary Holding Position

As illustrated in FIG. 16, when the slider 18 is held to the electric wire connector 19 at the temporary holding position, the electric wire 71 can be inserted into the female terminal 77 from the rear. When the front end of the core wire 72 is located within the window 37, the first recess 75 of the first holding portion 14 is opposed to the first protrusion 73 of the core wire 72. The second protrusion 76 of the second holding portion 15 is opposed to the second recess 74 of the core wire 72.

At Permanent Holding Position

Figure 17:
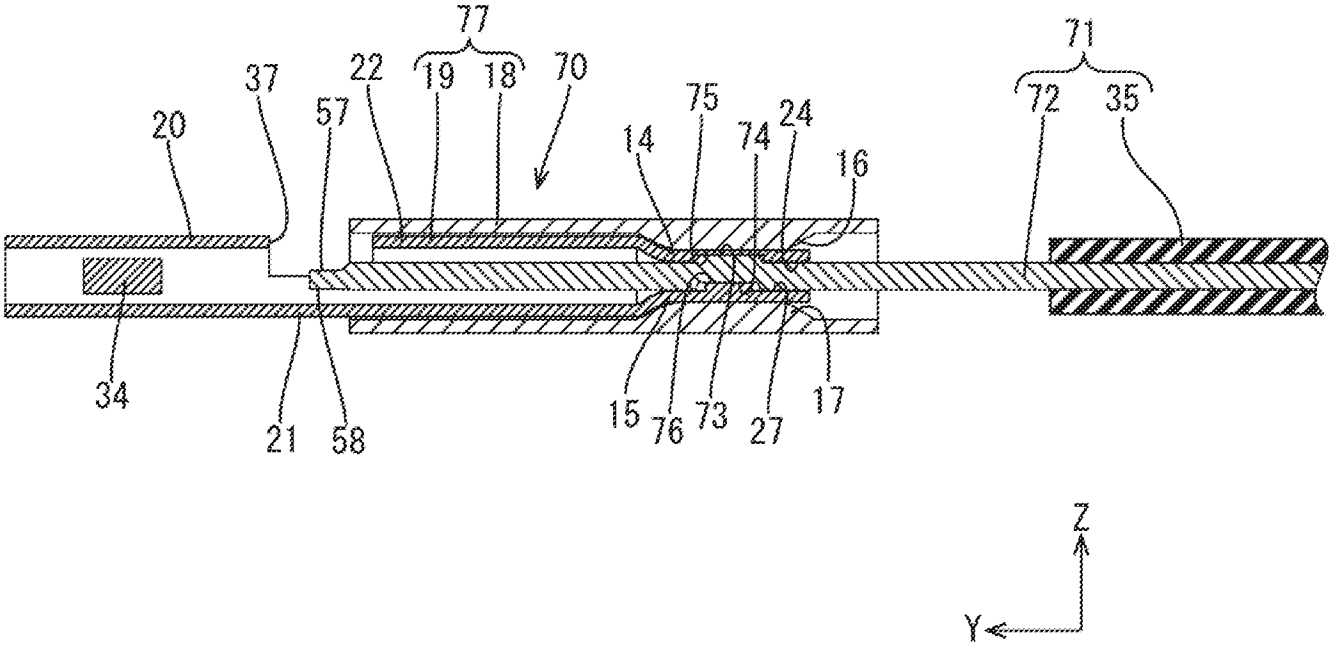
FIG. 17 is a cross-sectional view illustrating the electric wire inserted in the female terminal with the slider held to the electric wire connector at a permanent holding position.
Figure 18:
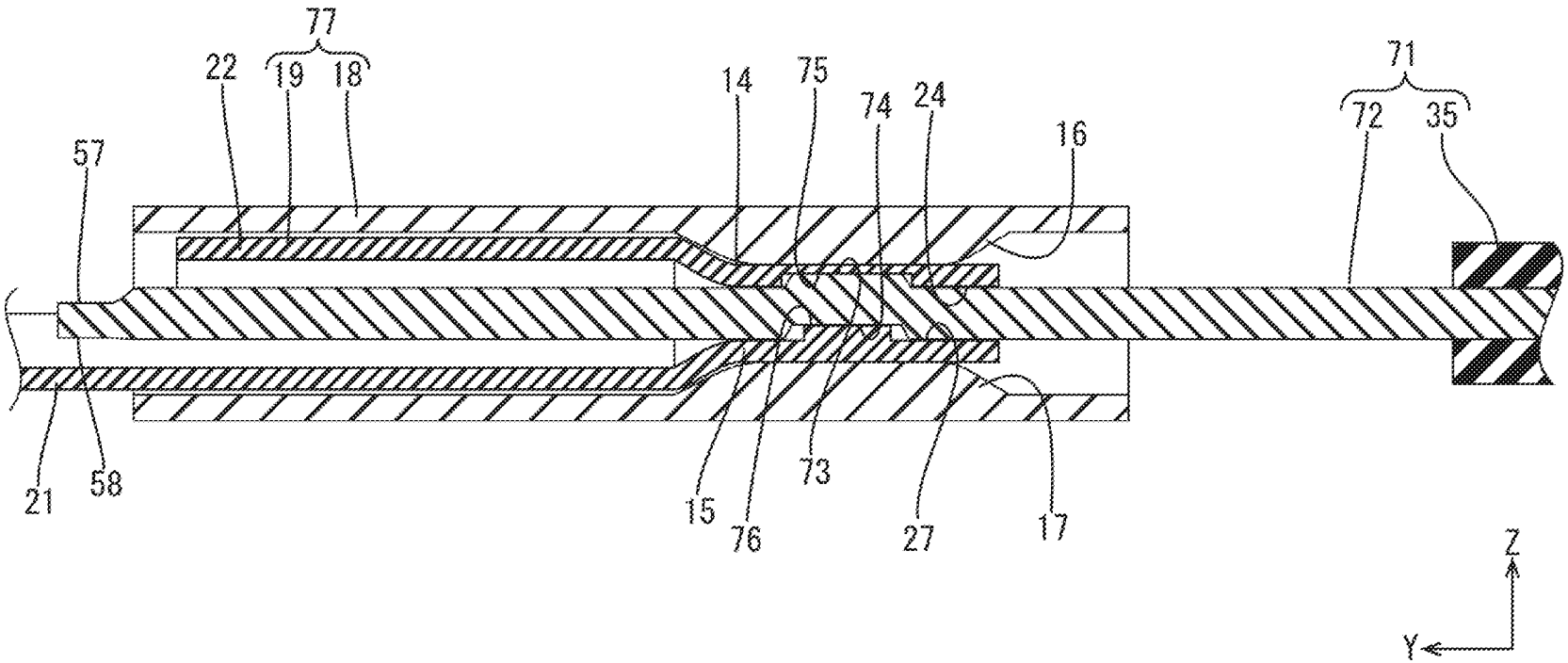
FIG. 18 is a magnified partial cross-sectional view illustrating connection between the electric wire and the female terminal.

As illustrated in FIGS. 17 and 18, when the slider 18 is held to the electric wire connector 19 at the permanent holding position, the first protrusion 73 of the core wire 72 is located inside the first recess 75 of the first holding portion 14. The second protrusion 76 of the second holding portion 15 is located inside the second recess 74 of the core wire 72.

Configurations other than those described above are similar to those of the second embodiment. Components having the same configurations as those of the components of the second embodiment will be indicated by the same symbols and will not be described in detail.

In this embodiment, the first protrusion 73 and the second recess 74 of the core wire 72 are included in the bent section of the core wire 72. By bending the core wire 72, which is a simple method, the first protrusion 73 and the second recess 74 can be formed.

Other Embodiments

The technology described herein is not limited to the embodiments described above and illustrated in the drawings. For example, the following embodiments will be included in the technical scope of the technology described herein.

(1) In the above embodiments, the female terminal 12 is provided as an example of a terminal. However, a male terminal or a round terminal may be used. Alternatively, a splice terminal for connecting multiple electric wires 11 may be used.

(2) In the above embodiments, the electric wire 11 is provided with the sheath. However, the electric wire 11 may be a bare wire. The electric wire 11 may be a stranded wire including metal fine wires that are stranded.

(3) In the above embodiments, the female terminal 12 includes the first holding portion 14 and the second holding portion 15. However, the female terminal 12 may include a single holding portion or three or more holding portions.

(4) In the above embodiments, the base portion 22 has the rectangular tube shape. However, the base portion 22 may have a round tube shape, or a polygonal tube shape including a triangular tube shape and a hexagonal tube shape. The slider 18 may have a round tube shape or a polygonal tube shape including a triangular tube shape.

(5) In the above embodiments, the slider 18 that is movable in the front-rear direction includes the first pressing portion 16 and the second pressing portion 17. However, a slider that is movable in the vertical direction including pressing portions may be used and moved from above toward the electric wire to press the holding portions from above.

(6) In the above embodiments, the upper flat surface 57 of the end of the electric wire is provided as the marker. However, the marker may be provided in a form of a groove, a rib, a protrusion, or any other shape in the end of the electric wire.

(7) In the above embodiments, the core wire has the round cross section. However, the cross section of the core wire may be rectangular, oval, or any other appropriate shape.

EXPLANATION OF SYMBOLS

10, 50, 70: Electric cable including terminal
11, 51, 71: Electric wire
12, 59, 77: Female terminal
14: First holding portion
15: Second holding portion
16: First pressing portion
17: Second pressing portion
20: Connecting tube portion
25, 55, 73: First protrusion
26: First retaining section
28, 56, 76: Second protrusion
29: Second retaining section
36: Recess
37: Window
53, 75: First recess
54, 74: Second recess
57: First flat surface

The invention claimed is:

1. An electric cable including a terminal, the electric cable comprising:

an electric wire;

a terminal including a holding portion holding the electric wire and a pressing portion pressing the holding portion toward the electric wire, wherein one of the electric wire and the holding portion includes a protrusion protruding toward another one of the electric wire and the holding portion, and the other one of the electric wire and the holding portion includes a recess in which the protrusion is fitted.

2. The electric cable including the terminal according to claim 1, wherein the holding portion includes a retaining section at a position different from the protrusion or the recess to hold the electric wire.

3. The electric cable including the terminal according to claim 2, wherein the terminal includes a connector coupled to the holding portion and configured to be connected with a meting terminal, and the retaining section is between the connector and the protrusion or the recess.

4. The electric cable including the terminal according to claim 1, wherein the terminal includes a window through which the end of the electric wire is detectable, the window being at a position corresponding to an end of the electric wire.

5. The electric cable including the terminal according to claim 1, wherein the end of the electric wire includes a marker, and the marker is formed on a side of the electric wire on which the protrusion or the recess is formed.

6. The electric cable including the terminal according to claim 1, wherein the protrusion or the recess is included in a bent section of the electric wire.

* * * * *